United States Patent [19]

Pedziwiatr

[11] 4,409,999

[45] Oct. 18, 1983

[54] AUTOMATIC ULTRASONIC CLEANING APPARATUS

[76] Inventor: Edward A. Pedziwiatr, 50 Glenview Ter., Cresskill, N.J. 07626

[21] Appl. No.: 290,963

[22] Filed: Aug. 7, 1981

[51] Int. Cl.[3] ..... B08B 3/02

[52] U.S. Cl. ..... 134/95; 134/102; 134/184

[58] Field of Search ..... 134/95, 184, 102

[56] References Cited

U.S. PATENT DOCUMENTS 3,690,333 9/1972 Kierner ..... 134/95

3,893,869 7/1975 Mayer et al. ..... 134/184 X 4,193,818 3/1980 Young et al. ..... 134/102 X

FOREIGN PATENT DOCUMENTS 344902 8/1972 U.S.S.R. ..... 134/184

*Primary Examiner*—Robert L. Bleutge

*Attorney, Agent, or Firm*—Samuelson & Jacob

[57] ABSTRACT

Automatic ultrasonic cleaning apparatus in which a single ultrasonic cleaning tank is alternately filled and drained with cleaning solution and rinsing solution and is supplied with drying air in accordance with a programmed cycle of operation.

3 Claims, 1 Drawing Figure

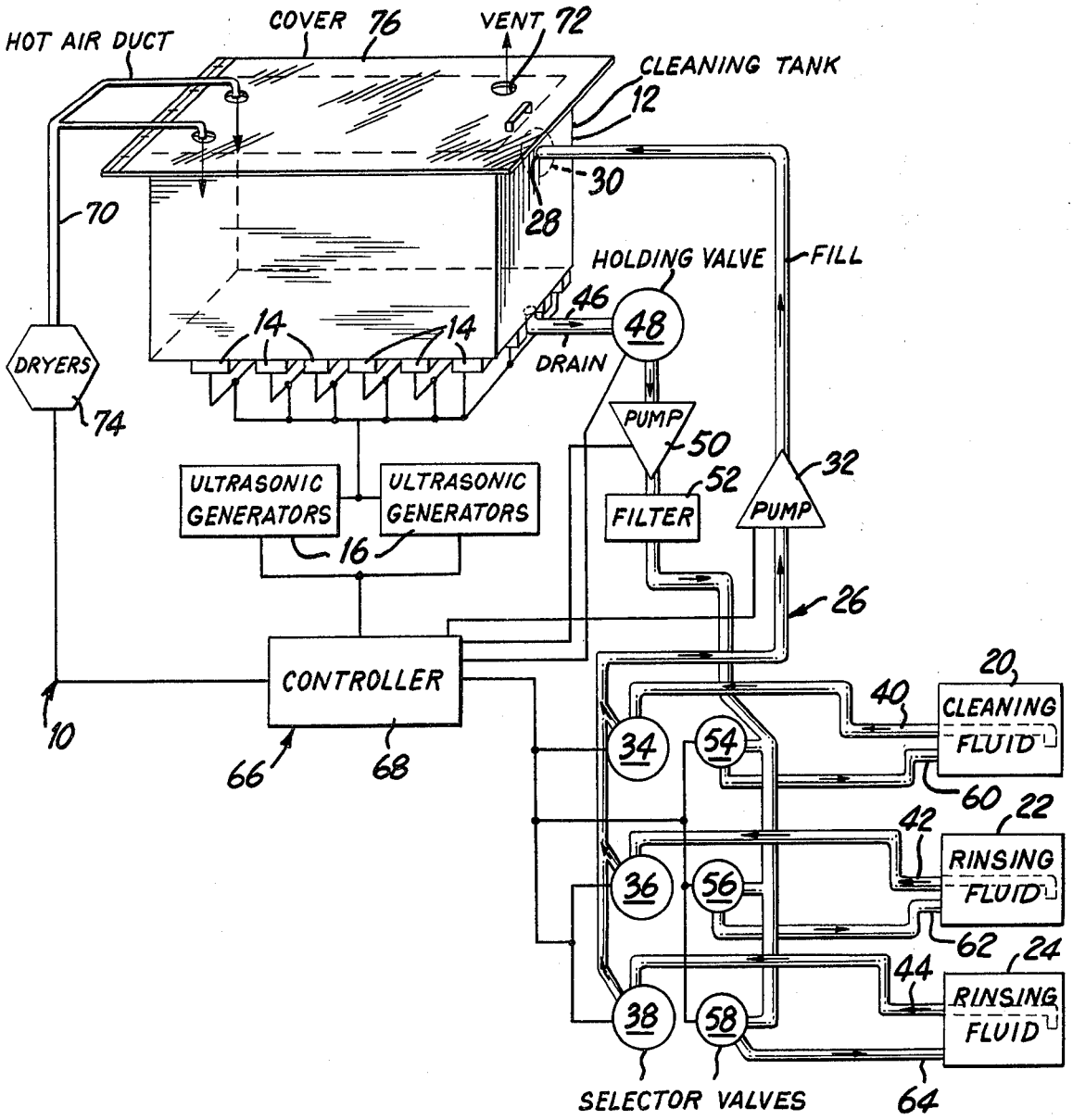
HOT AIR DUCT
COVER 76
VENT 72
CLEANING TANK
12
30
28
70
HOLDING VALVE
FILL
46
48
14
14
DRAIN
DRYERS
74
PUMP
50
32
ULTRASONIC GENERATORS
ULTRASONIC GENERATORS
52
FILTER
PUMP
16
26
CONTROLLER
20
CLEANING FLUID
40
10
34
54
60
66
68
22
42
RINSING FLUID
36
56
62
24
44
RINSING FLUID
38
58
SELECTOR VALVES
64

AUTOMATIC ULTRASONIC CLEANING APPARATUS

The present invention relates generally to ultrasonic cleaning apparatus and pertains, more specifically, to automatic apparatus in which cleaning, rinsing and drying fluids are introduced and removed from a single ultrasonic cleaning tank in accordance with a predetermined timed cycle of operation.

Present ultrasonic cleaning machines usually employ separate tanks for containing different solutions which enable cleaning and rinsing of various items by moving the items from one tank to another. A separate drying chamber usually is employed to dry the items subsequent to cleaning and rinsing.

It is an object of the present invention to provide a more compact, more efficient and more effective ultrasonic cleaning apparatus in which a single cleaning tank is supplied, alternately, with cleaning and rinsing fluids and is supplied with drying air in accordance with a timed cycle so as to enable cleaning of items in a single tank without requiring removal of the item from tank to tank to accomplish cleaning, rinsing and drying.

Another object of the invention is to provide an ultrasonic cleaning apparatus in which the cleaning tank is enclosed during cleaning, rinsing and drying operations so as to preclude the uncontrolled escape of volatile materials into the environment surrounding the apparatus.

The above objects, as well as still further objects and advantages, are attained by the present invention which may be described briefly as an ultrasonic cleaning apparatus comprising: a cleaning tank; a plurality of fluid storage containers for containing cleaning and rinsing solutions; conduit means in communication with each of the fluid storage containers and the cleaning tank, the conduit means including pumping means for enabling the passage of fluid from each container to the tank and return of fluid from the tank to the container; and control means coupled with the conduit means for enabling said passage and return of each fluid in accordance with a predetermined timed cycle of operation.

The invention will be more fully understood in the following detailed description of an embodiment of the invention illustrated in the accompanying drawing which is a partially diagrammatic, schematic layout of an apparatus constructed in accordance with the invention.

Referring now to the drawing, ultrasonic cleaning machine 10 is seen to have a single cleaning tank 12 to which there are attached a plurality of ultrasonic transducers 14 driven by ultrasonic generators 16 in a conventional manner now well known in cleaning machines.

A plurality of fluid storage containers 20, 22 and 24 are connected to the cleaning tank 12 by means of a conduit system 26. The conduit system 26 includes a filler spout 28 adjacent the top of the tank 12. In some instances a spray head 30 may be included at the exit from the filler spout 28. Conduit system 26 further includes a supply pump 32 and a plurality of solenoid-operated supply valves 34, 36 and 38 connected to filler tubes 40, 42 and 44 which enter corresponding storage containers 20, 22 and 24.

Conduit system 26 further includes a drain conduit 46 which passes into a holding valve 48 and then to a drain pump 50 and through filter 52 to solenoid-operated valves 54, 56 and 58 which control the return of fluid to corresponding storage containers 20, 22 and 24 through return tubes 60, 62 and 64.

Control means 66 includes a controller 68 which controls the operation of pumps 32 and 50, and the solenoid-operated valves 34, 36 and 38 and 54, 56 and 58, as well as the operation of ultrasonic generators 16 as follows: Storage container 20 contains a cleaning solution which is pumped into tank 12 by pump 32, through valve 34 and is held in the tank for a predetermined time interval, by the holding valve 48. The ultrasonic generators 16 are operated during this time interval to actuate the transducers 14 for ultrasonic cleaning of items placed in the tank 12. Upon completion of the cleaning operation, the cleaning solution is drained from tank 12 through holding valve 48 by pump 50, through valve 54 and return tube 60 to container 20. Then, a first rinsing solution is supplied to tank 12 from container 22, in a similar manner, and the ultrasonic generators 16 again are operated for a first rinsing operation. When the first rinse is completed, the rinsing solution is drained back into container 22 and a second rinsing solution is supplied to tank 12 from container 24, again through the operation of pump 32 and the appropriate valves. A second rinsing operation is then completed by operating the ultrasonic generators 16 for an appropriate timed interval, and the rinsing solution is returned to container 24, thereby completing the cleaning and rinsing cycle of operation.

It is noted that the filler tubes 40, 42 and 44 do not extend all the way to the bottom of each container 20, 22 and 24 so that any sludge or other contaminants will settle to the bottom of each container and will not be returned to the cleaning tank 12.

In order to dry the items cleaned in tank 12, drying fluid is supplied to tank 12 through an inlet duct 70 and is vented through a vent 72. Usually the drying fluid is hot air supplied by a blower 74 which is also under the control of control means 66. Other drying fluids may be utilized for special drying requirements. Steam may be used for sterilization, as well as for drying, if desired.

Cleaning tank 12 includes a cover 76 which encloses the tank and precludes the uncontrolled escape of any deleterious fumes to the ambient atmosphere.

It is to be understood that the above detailed description of an embodiment of the invention is provided by way of example only. Various details of design and construction may be modified without departing from the true spirit and scope of the invention as set forth in the appended claims.

The embodiments of the invention in which an exclusive property or privilege is claimed are defined as follows:

1. An ultrasonic cleaning apparatus comprising:

a cleaning tank;

a plurality of fluid storage containers for containing cleaning and rinsing solutions;

conduit means in communication with each of the fluid storage containers and the cleaning tank, said conduit means including pumping means between each container and the tank for enabling the passage of fluid from each container to the tank and return of fluid from the tank to the container; and control means coupled with the conduit means for enabling said passage and return of each fluid in accordance with a predetermined time cycle of operation.

2. The invention of claim 1 including enclosure means for enclosing the cleaning tank from the ambient environment of the apparatus.

3. The invention of claim 1 or 2 including drying means for supplying a drying fluid to the cleaning tank, said drying means being coupled to the control means such that the drying fluid is supplied in accordance with said predetermined cycle of operation.

* * * * *